US005567900A

United States Patent [19]

Higashi

[11] Patent Number: 5,567,900

[45] Date of Patent: Oct. 22, 1996

[54] ELECTRONIC TONE GENERATOR SYSTEM WITH CPU AND DSP

[75] Inventor: Iwao Higashi, Shimonoseki, Japan

[73] Assignee: Yamaha Corporation, Japan

[21] Appl. No.: 257,929

[22] Filed: Jun. 10, 1994

[30] Foreign Application Priority Data

Jun. 15, 1993 [JP] Japan ..... 5-143160

[51] Int. Cl.[6] ..... G10H 1/18

[52] U.S. Cl. ..... 84/602

[58] Field of Search ..... 84/601, 602, 618, 84/DIG. 2

[56] References Cited

U.S. PATENT DOCUMENTS 5,200,564 4/1993 Usami et al. ..... 84/602

5,376,750 12/1994 Takeda et al. ..... 84/602

*Primary Examiner*—Stanley J. Witkowski

*Attorney, Agent, or Firm*—Graham & James

[57] ABSTRACT

A tone signal control system for controlling a tone signal supplied from a tone generator. The tone signal control system includes a CPU for executing a computational and control operation in accordance with an externally stored program, a DSP for executing a computational and control operation in accordance with an internally stored program, a memory accessible by both CPU and DSP, and an access controller for controlling an access by CPU and DSP to the memory. The access controller calculates a logical product of a clock signal, an access signal from CPU, and an access signal from DSP, and outputs the logical product as a CPU wait signal. The tone signal control system is not required to increase the number of pins too many even if CPU and DSP are assembled on a single chip.

12 Claims, 6 Drawing Sheets

ELECTRONIC TONE GENERATOR SYSTEM WITH CPU AND DSP

BACKGROUND OF THE INVENTION a) Field of the Invention

The present invention relates to an electronic circuit using a memory, and more particularly to a musical tone signal control system using a central processing unit (CPU) and a digital signal processor (DSP).

b) Description of the Related Art

A CPU is commonly used in an electronic musical instrument to generate and control a musical tone signal. CPU executes a program stored in a read only memory (ROM) by using a random access memory (RAM) as a working memory such as registers and makes a tone generator generate a tone signal.

Because of recent demands for sophisticated and versatile musical toes of an electronic musical instrument, the amount of signals to be processed by a tone signal control system has increased and it has been desired to speed up signal processing. In order to meet such requirements, DSP is prevailing for adding musical effects to a tone signal, particularly reverb and the like.

FIG. 7 shows an example of a circuit of an electronic musical instrument according to a prior art. Referring to FIG. 7, a CPU 53, memories 61 such as a ROM and a RAM, a tone generator 54, and a DSP 55 are connected to a CPU bus 51. A keyboard 65, tone color switches 67, and the like are also connected to the CPU bus 51 via an interface (I/F) 64.

Another memory 63 is connected to DSP 55 via a dedicated DSP bus 62. An output of DSP 55 is supplied to a sound system 57 including an amplifier, a loudspeaker, and the like, via a digital-analog converter (DAC) 56.

As a player manipulates the keyboard 65 and performs music, a music performance signal is sent via I/F 64 to CPU 53. In accordance with a program stored in the memory 61 and by using registers therein, CPU 53 generates tone parameters for generating a played tone signal and sends them to the tone generator 54. A tone signal generated by the tone generator 54 is supplied to DSP 55 so as to add musical effects such as reverb.

DSP 55 executes a predetermined music performance process by using the memory 63 such as a RAM, and sends the tone signal added with musical effects to DAC 56. DAC 56 converts the tone signal into an analog tone signal which is supplied to the sound system 57 to produce music sounds.

When any one of the tone color switches 57 is activated, a switching signal is sent via I/F 64 to CPU 53 which refers to the memory 61 and changes parameters or the like for the tone generator 54.

Recent improvement of integration of semiconductor devices has made possible to assemble both CPU and DSP on a single chip. With the advent of a single chip CPU and DSP, it is supposed that electronic circuits such as shown in FIG. 7 will prevail more and more.

Memories are often formed on a different chip from a single chip CPU and DSP. It is necessary to provide a CPU bus between CPU and memories and a DSP bus between DSP and memories. As a result, use of such a single chip CPU and DSP greatly increases the number of pins of a semiconductor integrated circuit.

It is often that an access frequency of DSP to a memory is much smaller than a maximum access frequency. In other words, a memory for DSP becomes idle during a long time. However, DSP is required to strictly synchronize with a DAC cycle of DAC connected to DSP, and no wait is permitted.

SUMMARY OF THE INVENTION

It is an object of the present invention to provide a tone signal control system having a single chip CPU and DSP without greatly increasing the number of pins.

According to one aspect of the present invention, a tone signal control system for controlling a tone signal supplied from a tone generator is provided. The tone signal control system includes a CPU for executing a computational and control operation in accordance with an externally stored program, a DSP for executing a computational and control operation in accordance with an internally stored program, a memory accessible by both CPU and DSP, and access control means for controlling access by CPU and DSP to the memory.

It is preferable that the access control means gives an access priority to DSP when both CPU and DSP access the memory at the same time. It is also preferable that the access control means includes concurrent access detection means for detecting a concurrent access by CPU and DSP and wait signal generator means responsive to a detection signal from the concurrent access detection means for generating a CPU wait signal for making CPU suspend the memory access.

The same memory is shared by CPU and DSP so that the numbers of busses and pins can be reduced and hardware resources can be effectively used.

CPU and DSP use the same memory in common so that the circuit of the tone signal control system can be simplified. If CPU and DSP are assembled on a single chip, the number of pins of the integrated circuit can be reduced.

An access to the memory by CPU and DSP is controlled by the address control means. The operation of DSP is not hindered because an access priority is given to DSP. Even if the accesses by CPU and DSP occur at the same time, the access by CPU can be delayed without any practical problem of the CPU operation The other objects, features, and advantages of the invention will become more apparent from the detailed description of embodiments when read in conjunction with the accompanying drawings.

DETAILED DESCRIPTION OF THE PREFERRED EMBODIMENTS

Figure 1:
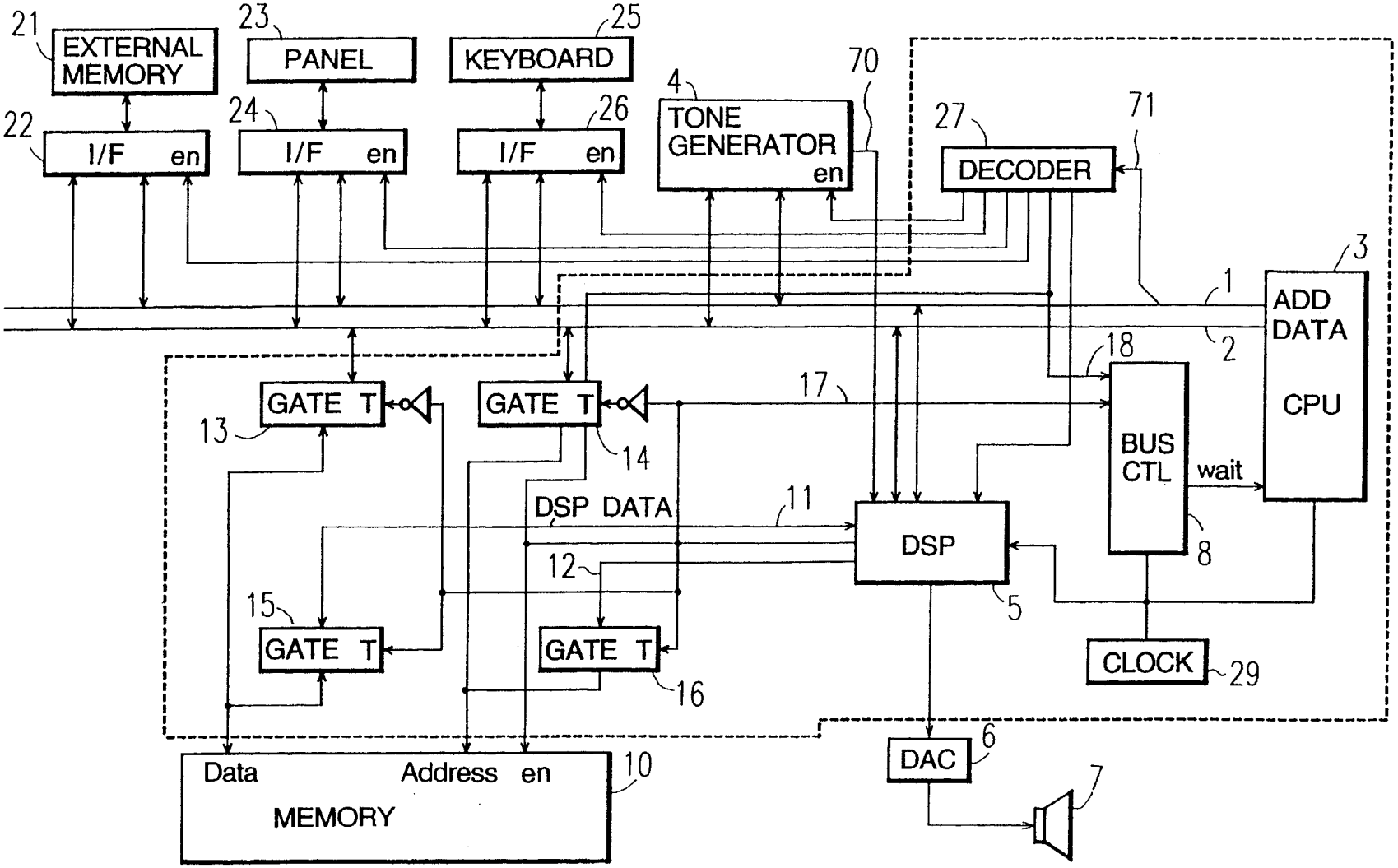
FIG. 1 is a block diagram of a tone signal control system according to an embodiment of the invention.

FIG. 1 is a block diagram of a tone signal control system according to an embodiment of the invention.

A CPU address bus and a CPU data bus 2 are connected to a CPU 3 An external memory 21, a panel 23, and a keyboard 25 are connected to the busses 1 and 2 via respective interfaces 22, 24, 26, for data transfer to and from CPU 3.

A tone generator 4 is connected to the busses 1 and 2, the tone generator 4 generating a tone signal under the control of CPU 3. A tone signal 70 generated by the tone generator 4 is supplied to a DSP 5 which performs operations such as adding musical effects to the supplied tone signal and outputs the processed tone signal to a digital-analog converter (DAC) 6.

DAC 6 converts the digital signal supplied from DSP 5 into an analog signal, and supplies the converted analog signal to a sound system 7 to produce music sounds. DSP 5 is also connected to the busses 1 and 2 and is controllable by CPU3;

Each circuit under the control of CPU 3 has a plurality of in-circuit storage areas. CPU 3 and each circuit transfer data therebetween via storage areas.

CPU 3 outputs address data to each circuit via the CPU address bus 1. The address data is m-bit data (m: positive integer). The upper n (n: positive integer, n<m) bits identify each circuit. The (n+1)-th bit from MSB distinguishes between read and write. The lower bits from the (n+2)-th to LSB identify one of a plurality of storage areas of each circuit.

CPU 3 outputs address data, reads data stored in a storage area of each circuit, and performs a predetermined process in accordance with the read data.

Alternatively, CPU 3 outputs address data, writes data for operating each circuit in a storage area thereof, and operates each circuit in accordance with the written data.

A memory 10 such as a RAM has an address terminal, a data terminal, and an enable terminal. The address terminal of the memory 10 is connected to the CPU address bus 1 via an address bus gate 14, and to a DSP address bus 12 of DSP 5 via an address bus gate 16.

The data terminal of the memory 10 is connected to the CPU data bus 2 via a data bus gate 13, and to a DSP data bus 11 of DSP 5 via a data bus gate 15.

The enable terminal of the memory 10 is connected to a CPU access line 18 of a decoder 27 via the address bus gate 14, and to a DSP access line 17 of DSP 5.

The memory 10 is enabled when a signal "1" is supplied from DSP 5 or the decoder 27 to the enable terminal. If the (n+1)-th bit of address data supplied to the address terminal indicates data read, the data stored in the memory 10 at an address represented by the succeeding lower bits is read and outputted from the data terminal. On the other hand if the (n+1)-th bit of address data supplied to the address terminal indicates data write, the data supplied to the data terminal is written in the memory 10 at an address represented by the succeeding lower bits.

The decoder 27 is connected to the CPU address bus 1, and supplies a decoded signal to the tone generator 4, I/Fs 22, 24, or 26, or DSP 5. The CPU access line 18 is connected from the decoder 27 to a bus controller 8 and the address bus gate 14.

The decoder 27 decodes the upper n bits of address data 71 outputted from CPU 3, and outputs a signal "1" to the circuit identified by the upper n bits of the address data to enable this circuit.

When the decoder 27 outputs a decoded signal to the tone generator 4, I/Fs 22, 24, or 26, or DSP 5, the circuit supplied with the decoded signal reads the data stored in the storage area identified by the address data bits lower than the (n+1)-th bit if this bit indicates data read, and writes the data supplied from CPU data bus 2 in the storage area identified by the address data bits lower than the (n+1)-th bit if this bit indicates data write. When CPU 3 outputs the address data designating the memory 10, the decoder 27 outputs the signal "1" to the CPU access line 18.

The DSP access line 17 from DSP 5 is connected to the data bus gate 15, address bus gate 16, enable terminal of the memory 10, and bus controller 8, and to the data bus gate 13 and address bus gate 14 via inverters.

DSP 5 outputs a signal "1" to the DSP access line 17 to access the memory 10.

When a signal "1" is supplied to the terminals T of the data bus gates and 15 and address bus gates 14 and 16, data supplied to the gates passes therethrough, and when a signal "0" is supplied, data supplied to the gates is inhibited to pass therethrough.

The bus controller 8 receives signals from the CPU access line 18 and DSP access line 17, and supplies a wait (standby) signal to CPU 3 when the memory accesses by DSP 5 and CPU 3 occur at the same time.

A clock circuit 29 generates a clock signal which controls the entire system, and supplies it to CPU 3, DSP 5, bus controller 8, and other circuits. CPU 3, DSP 5, and other circuits can thus operate synchronously.

The circuit portion surrounded by a broken line in FIG. 1 is assembled of a single semiconductor chip. The broken line is not drawn strictly, however, relative to the bus lines for the simplicity of the drawing. If the memory 10 is a RAM, the program of CPU 3 is written from the external memory 21 to the memory 10 after the system power is turned on.

CPU 3 sets performance environments in accordance with the settings of the panel 23, and sets tone signal forming parameters to the tone generator 4 to generate a tone signal in accordance with the program stored in the memory 10. DSP 5 gives music effects such as reverb to a tone signal supplied from the tone generator 4.

As shown in FIG. 1, the memory 10 can be shared by CPU 3 and DSP 5 via the gates 13 and 14 and gates 15 and 16.

Figure 2:
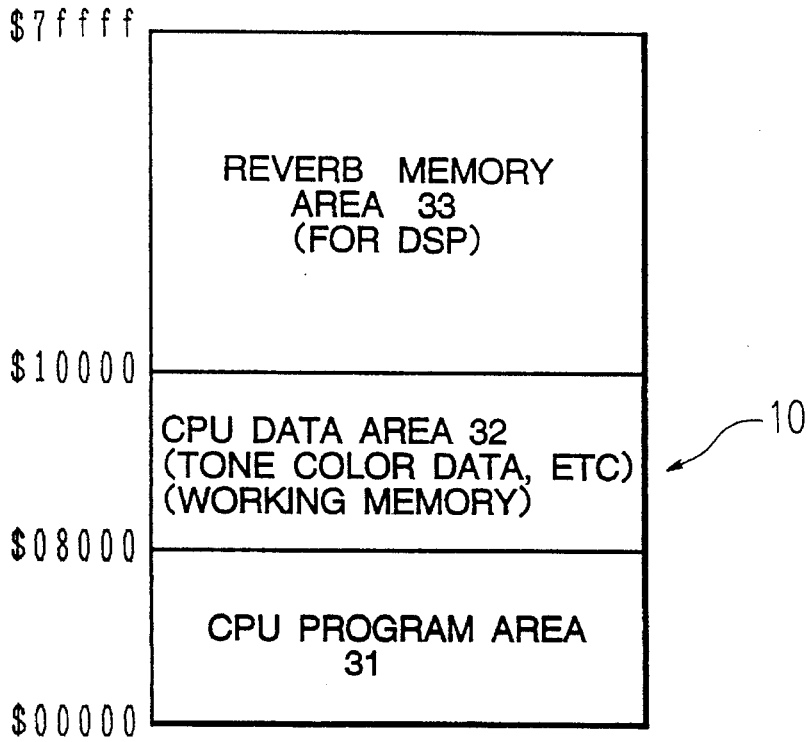
FIG. 2 is a memory map of the memory of the embodiment shown in FIG. 1.

FIG. 2 is a memory map of the memory 10. The memory 10 has a capacity corresponding to the storage area from a memory address $00000 to a memory address $7ffff. The area from $00000 to $08000 is a CPU program area 31, and the area from $08001 to $10000 is a CPU data area 32 which functions as a working memory for storing tone color data and the like. The area from $10001 to $7ffff is a reverb memory area 33 which is used by DSP 5.

DSP 5 or CPU 3 generates an address signal together with a DSP access signal or a CPU access signal to access the memory 10. The bus controller 8 is provided for preventing a malfunction to be caused by concurrent accesses by CPU 3 and DSP 5.

Figure 3:
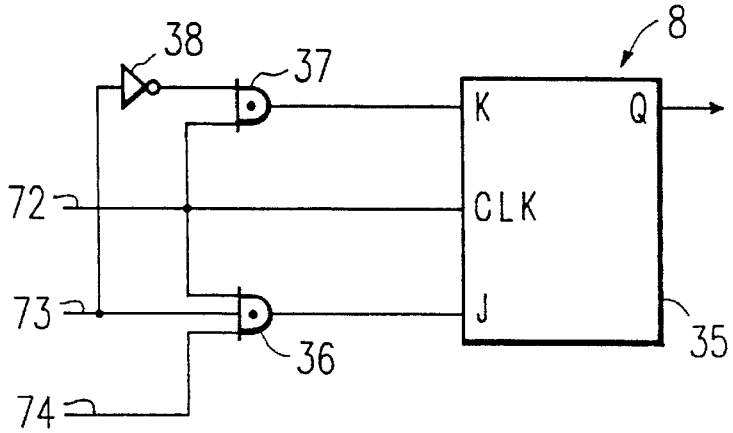
FIG. 3 is a block diagram showing an example of the circuit arrangement of the bus controller of the embodiment shown in FIG. 1.

FIG. 3 shows an example of the circuit arrangement of the bus controller 8. Three signals including the clock signal, 72

DSP access signal 73, and CPU access signal are supplied to an AND gate 36 whose output is supplied to the J terminal of a JK flop-flop 35.

When the three signals all become "1", a signal "1" is supplied to the J terminal of the JK flip-flop 85 and a signal "1" is outputted from the Q terminal thereof. This signal "1" at the Q terminal is used as the CPU wait signal which is supplied to CPU 3 to make CPU 3 suspend the memory access.

When the DSP access signal changes from "1" to "0", a signal "1" is supplied via an inverter 38 to one input terminal of an AND gate 37.

The other input terminal of the AND gate 37 is supplied with the clock signal so that a signal "1" is supplied to the K terminal of the JK flip-flop 35 at the next clock after the DSF access signal extinguished. When the signal "1" is supplied to the K terminal, the CPU wait signal at the Q terminal extinguishes (becomes "0").

The DSP access signal and CPU access signal are generated synchronously with a clock signal so that there is always one clock signal when the DSP access signal or CPU access signal is generated.

When the memory accesses by DSP 5 and CPU 3 occur at the same time, the bus controller 8 makes CPU 3 suspend the memory access and gives a memory access priority to DSP 5.

An output of DSP 5 is synchronized with the DAC cycle of DAC 6 so that the process by DSP cannot be delayed. Even if the memory accesses by DSP 5 and CPU 3 occur at the same time, the bus controller 8 always gives the process by DSP 5 with a priority over CPU 3 so that the process by DSP 5 will not be hindered.

Although a memory access by CPU 3 is suspended when the memory access occurs concurrently with a memory access by DSP 5, the suspension time of CPU 3 will not become too long because the memory access frequency of DSP 5 is low.

Figure 4:
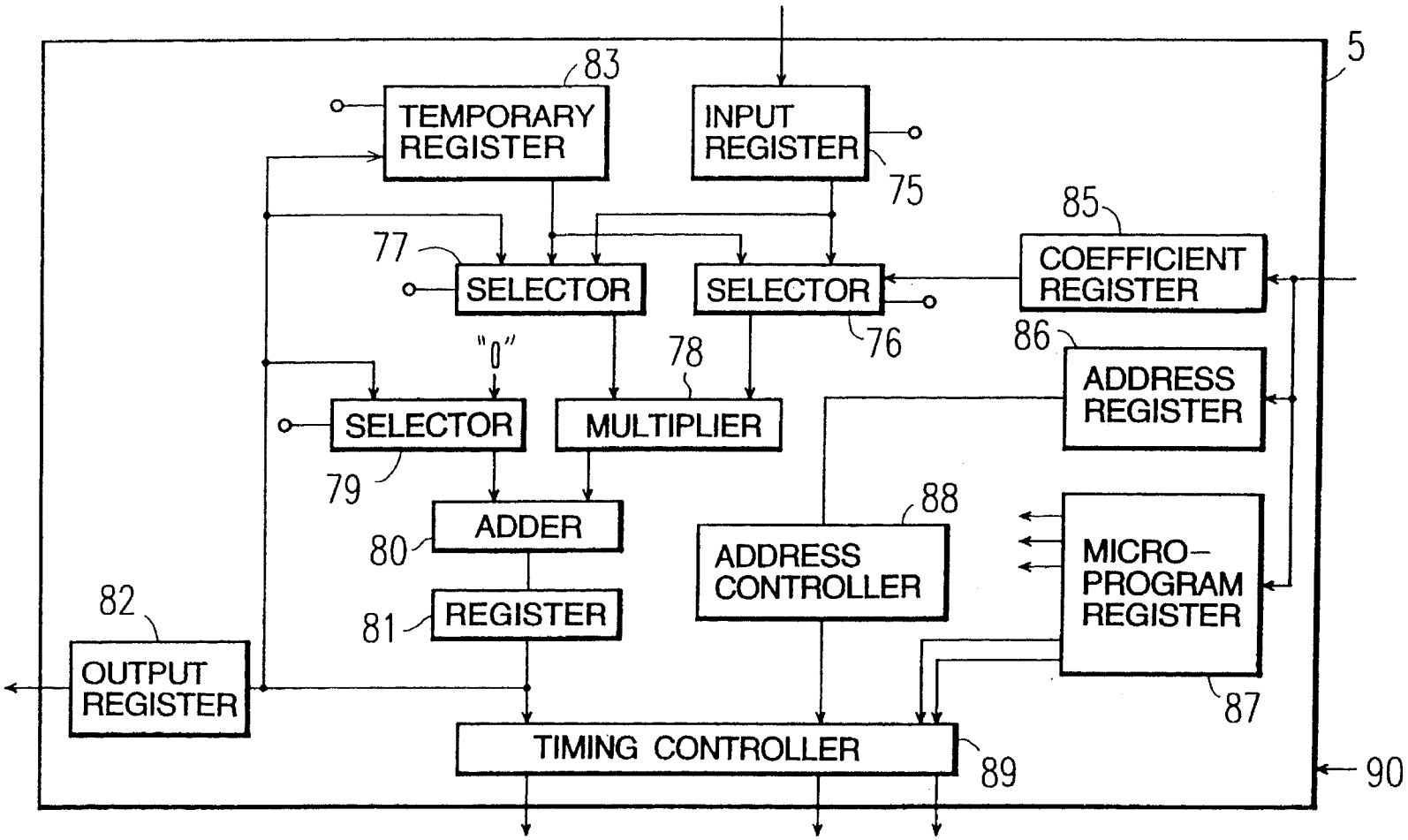
FIG. 4 is a block diagram showing an example of the circuit arrangement of DSP of the embodiment shown in FIG. 1.

FIG. 4 shows an example of the internal structure of DSP 5. An input signal to DSP 5 is inputted to an input register Reg1 75 whose output is supplied to selectors 76 and 77. Outputs of the selectors 76 and 77 are supplied to a multiplier 78.

Output of the multiplier 78 and a selector 79 are supplied to an adder 80 whose output is supplied to a register 81. An output of the register 81 is sent from an output register 82 to DAC 6, and sent directly to a temporary register 83. An output of the temporary register 83 is supplied to the selectors 76 and 77.

An output of the register 81 is supplied directly to the selector 77, bypassing the temporary register 83.

An output of the register 81 is also supplied to one input terminal of the selector 79. The other input terminal of the selector 79 is supplied with a signal "0". When the signal "0" is selected, the selector 79 supplies it to the adder 80. In this case, the adder 80 functions simply to transmit an output of the multiplier 78 to the register Reg3. In this way, DSP 5 has a structure basically constituted by combinations of the multiplier and adder with registers and selectors.

DSP 5 has a coefficient register 85, an address register 86, and a microprogram register 87. DSP 5 controls its process in accordance with a program stored in the microprogram register 87.

The coefficient register 85 supplies a multiplication coefficient necessary for a multiplication by the multiplier 78. Each relative address in the address register 86 is translated by an address controller 88 into a physical address. When a read/write signal is outputted from a microprogram register 87, a timing controller 89 generates the DSP access signal.

A physical address from the address controller 88 is supplied to the timing controller 89 which generates a DSP address signal. An output of the register 81 is outputted via the timing controller 89 as DSP data.

Data and addresses are supplied from CPU 3 via the CPU data bus 2 and CPU address bus 1 to the coefficient register 85, microprogram register 87, and address register 86. A clock signal 90 is supplied from the clock circuit 29 to DSP 5.

Figure 5:
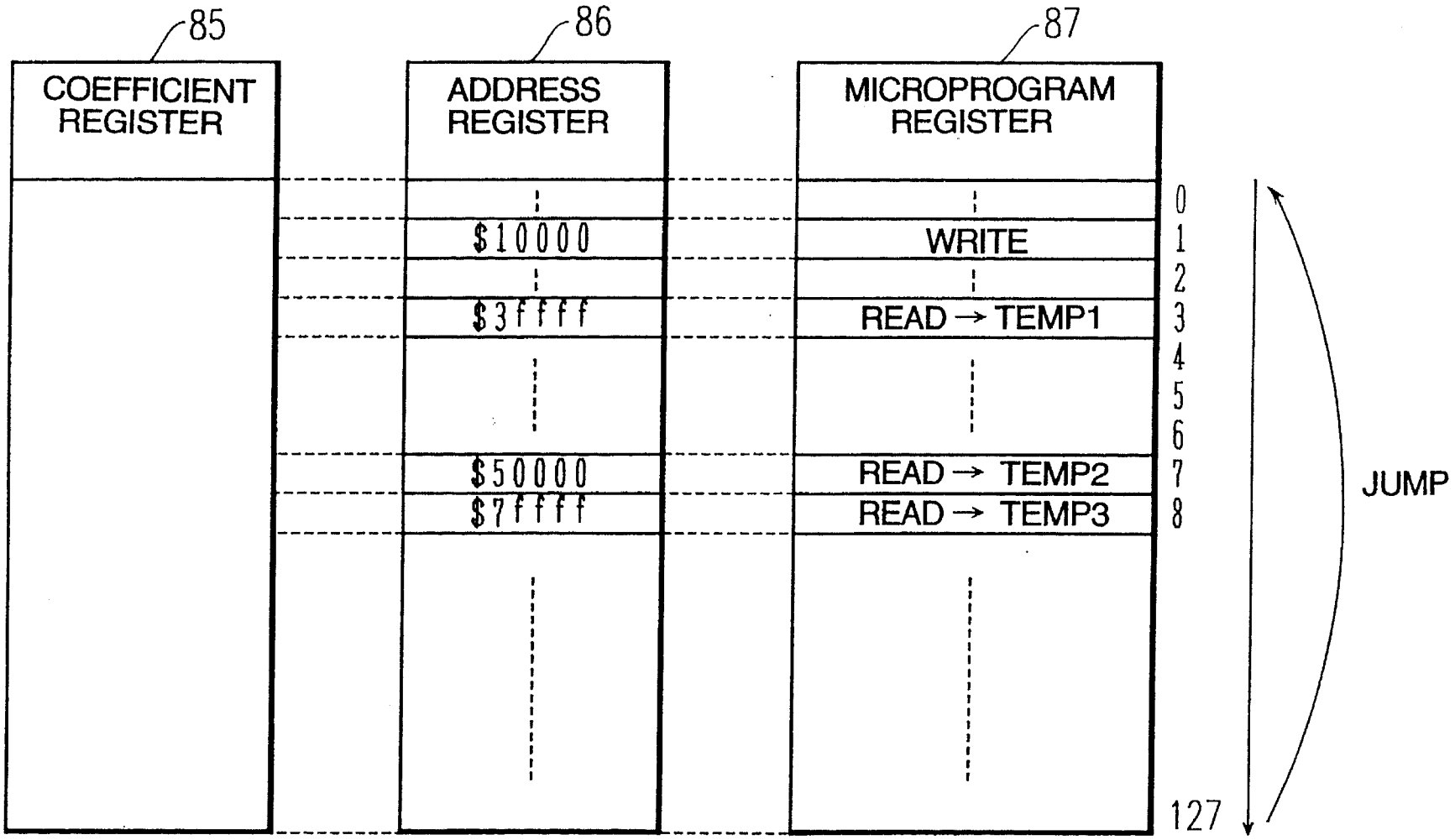
FIG. 5 is a schematic diagram showing an example of the structures of a coefficient register, an address register, a microprogram register, respectively of DSP shown in FIG. 4.

DSP 5 repeats the same computational operation at the left side circuit portion of FIG. 5. In this repetition, the address controller 88 decrements the memory address by 1 each time one computational operation is performed. When the address becomes the smallest number, the address jumps to the largest number.

FIG. 5 shows an example of the structures of the coefficient register 85, address register 86, and microprogram register 87 of DSP 5. In this example, the microprogram register 87 has 128 steps.

The microprograms stored in the microprogram register 87 are sequentially executed from "0" to "127" steps in response to a clock signal. After the step "127" has been executed, the microprogram returns to the step "0".

An address in the address register 86 changes synchronously with the execution of each microprogram in the microprogram register 87. For example, for the microprogram at the step "1" of "Write", a memory address $10000 is stored in the address register 86.

For the microprogram at the step "3" of "read", a memory address #3ffff is stored in the address register 86. In this case, data in the memory 10 at the address $3ffff is read and supplied to the temporary register Temp1.

Similarly, at the microprogram step "7", data is read from the memory 10 at an address $7ffff and supplied to the temporary register Temp3.

In this manner, data is read from and written in the memory 10 at the address designated by the address register 86 as each microprogram is executed. The coefficient in the coefficient register 85 also changes synchronously with the execution of each microprogram.

After one cycle of the microprograms has been executed, the memory address outputted from the address register 86 is decremented by 1 by the address controller 88.

When DSP 5 gives reverb effects to a tone signal generated by the tone generator 4, the tone signal is written in the memory 10 at a reverb memory area 33. After a lapse of a predetermined time, the tone signal is read in accordance with the microprogram and given with the reverb effects by DSP 5 shown in FIG. 4, the results being outputted to DAC 6.

The control of selectors, latches, and the like in DSP 5 is automatically performed in accordance with preset data stored in the microprograms, so that it is not necessary to refer to the memory 10. The memory access frequency of DSP 5 is therefore very small as compared to the clock frequency. An access of CPU 3 to the memory 10 is executed while DSP 5 is not accessing the memory 10.

An example of the structure and operation of DSP is detailed in Japanese Patent Laid-open No. 5-57504 filed by the present applicant, which is incorporated herein by reference.

The operation of the embodiment will be described.

Referring to FIG. 1, when CPU 3 accesses the memory 10, it outputs address data designating the memory 10. The decoder 27 decodes the address signal and outputs a signal "1" to the CPU access line 18. The signal "1" is supplied via the address bus gate 14 to the enable terminal of the memory 10 to enable it.

When DSP 5 accesses tile memory 10, it outputs a signal "1" to the DSP access line 17. This signal "1" is supplied to the enable terminal of the memory 10 to enable it.

If the memory accesses by CPU 3 and DSP 5 occur at the same time, the output signal "1" on the DSP access line 17 is supplied to the terminals T of the data bus gate 15 and address bus gate 16 so that the DSP data bus 11 and DSP address but 12 are connected to the memory 10.

The output signal "1" on the DSP access line 17 is inverted by the inverters and supplied to the terminals T of the data bus gate 13 and address bus gate 14 so that the CPU address bus 1 and CPU data bus 2 are not connected to the memory 10. The bus controller 8 detects the concurrent occurrence of the memory accesses by CPU 3 and DSP 5, and outputs a wait signal to CPU 3 while the signal "1" is outputted on the DSP access line 17.

While the wait signal is outputted from the bus controller 8, CPU 3 holds the memory access state. After the memory access by DSP 5 has been completed, a signal "0" outputted to the DSP access line 17 is inverted by the inverters and applied to the terminals T of the data bus gate 13 and address bus gate 14 so that the CPU address bus 1 and CPU data bus 2 are connected to the memory 10 and the memory access by CPU 3 is established.

Figure 6:
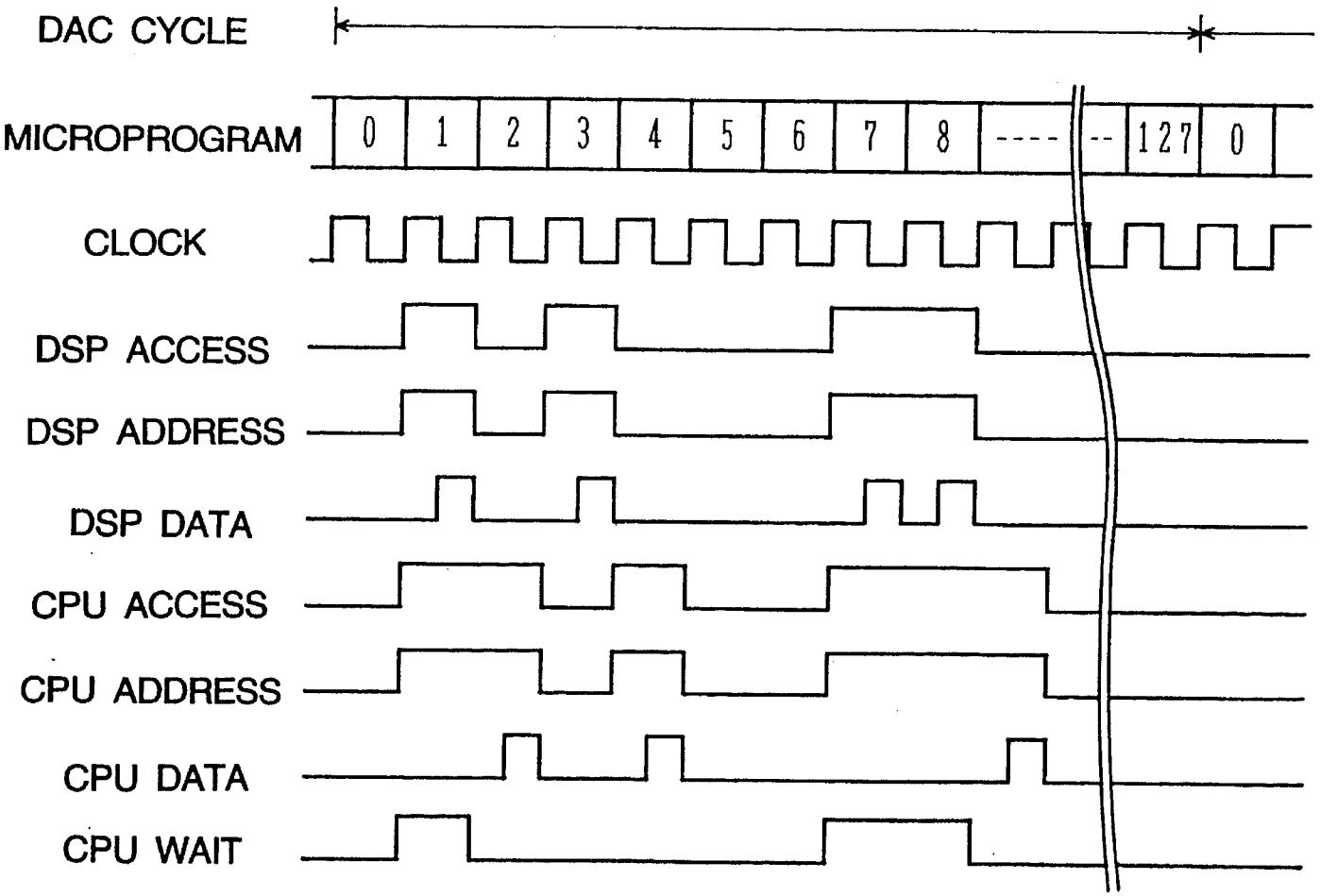
FIG. 6 is a timing chart explaining the operation of the embodiment shown in FIG. 1.
Figure 7:
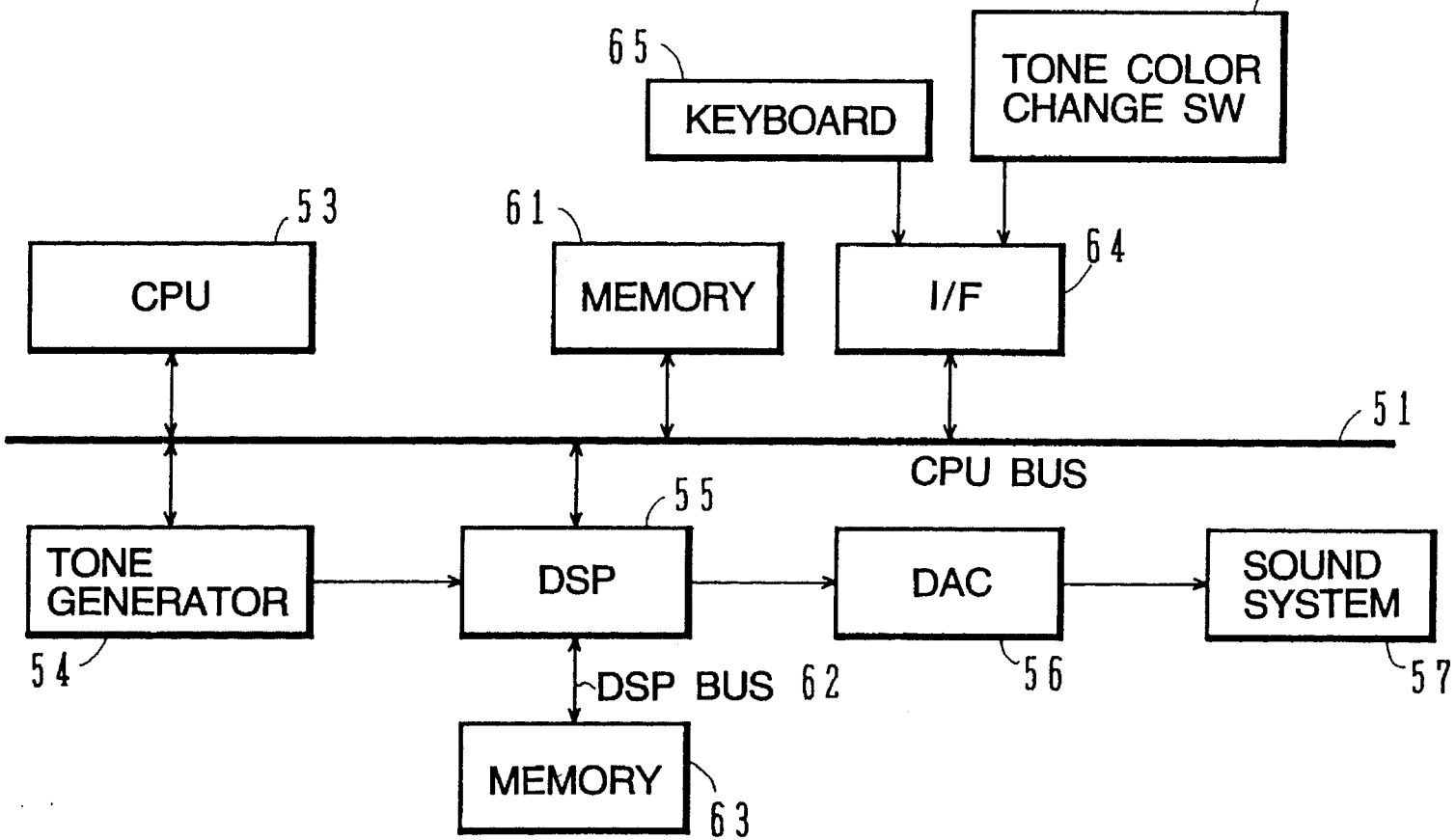
FIG. 7 (PRIOR ART)
FIG. 7 is a block diagram showing an example of the circuit arrangement of a conventional tone signal control system.

FIG. 6 is a timing chart explaining the memory access operations by DSP 5 and CPU 3. The highest row in FIG. 6 indicates a DAC cycle. Microprograms indicated at the second row are executed in one DAC cycle corresponding to 128 steps.

One cycle of a clock signal indicated at the third row completes at each microprogram step. A memory access by DSP 5 is executed by generating an access signal indicated at the fourth row and an address signal indicated at the fifth row.

At the first, third, seventh, and eighth microprogram steps shown in FIG. 6, a memory access by DSP 5 is executed. DSP data indicated at the fifth row (data written to or read from the memory 10) appears at the later period of each memory access step.

An access to the memory 10 by CPU 8 is executed by generating a CPU access signal indicated at the seventh row and a CPU address signal indicated at the eighth row. In the example shown in FIG. 6, at the first microprogram step, a memory access by CPU 3 occurs at the same time as the memory access by DSP 5. In this case, the bus controller 8 generates a CPU wait signal indicated at the later period of the second step.

The memory access by CPU 3 at the fourth step is allowed to be executed because there is no memory access by DSP 5.

The memory accesses by CPU 3 and DSP 5 are duplicate at the seventh step. In this case, a CPU wait signal is generated and the steep advances to the eighth step. However, the memory access by DSP 5 continues at the eight step so that the CPU wait signal continues to be generated.

At the ninth step, the memory access by DSP 5 is completed so that the CPU wait signal extinguishes to allow the memory access by CPU 3.

With the above timing control, the same memory can be used in common by DSP 5 and CPU 3. The operation of DSP 5 is not hindered because a memory access by DSP 5 is always executed preferentially. A memory access by CPU 3 is executed immediately after a memory access by DSP 5 is completed, although the former access is suspended if the latter access occurs duplicatively.

If the circuit portion surrounded by a broken line is assembled in a single chip, only a set of address and data pins is required for the interconnection between the chip and the memory 10. The number of pins can be greatly reduced as compared to a tone signal control system using separate memories for DSP and CPU.

In the above description, a single DSP and a single CPU are used for the tone signal control system. A plurality of CPUs and DSPs may also be used. In the above description, the reverb effects are given by DSP. Other various effects maybe given by DSP.

The present invention has been described in connection with the preferred embodiments. The invention is not limited only to the above embodiments. It is apparent to those skilled in the art that various modifications, improvements, combinations and time like can be made without departing from the scope of the appended claims.

I claim:

1. A tone signal control system for controlling a tone signal supplied from a tone generator, the system comprising:

a central processing unit for executing a computational and control operation in accordance with an externally stored program;

a digital signal processor for executing a computational and control operation in accordance with an internally stored program;

a memory accessible by both said central processing unit and said digital signal processor, said central processing unit and said digital signal processor generating an access signal to access said memory; and access control means for controlling access by said central processing unit and said digital signal processor to said memory, said access control means giving an access priority to said digital signal processor when said access signal by said central processing unit and said access signal by said digital signal processor are generated at the same time.

2. A tone signal control system according to claim 1, wherein said access control means includes concurrent access detection means for supplying a wait signal to said central processing unit when said access signals are generated from both said digital signal processor and said central processing unit at the same time.

3. A tone signal control system according to claim 2, wherein said concurrent access detection means includes an AND gate for calculating a logical product of said access signal by said digital signal processor and said access signal by said central processing unit.

4. A tone signal control system according to claim 2, further comprising a clock circuit for generating a clock signal controlling a plurality of operating timings of said digital signal processor and said central processing unit, said concurrent access detection means including an AND gate for calculating a logical product of said clock signal, said access signal by said digital signal processor, and said access signal by said central processing unit.

5. A tone signal control system according to claim 1, wherein said access control means includes means for inhibiting a transmission of an address signal from said central processing unto said memory.

6. A tone signal control system according to claim 4, wherein said access control means includes means for inhibiting a transmission of an address signal from said central processing unit to said memory.

7. A tone signal control system according to claim 1, wherein said digital signal processor stores a microprogram comprising a plurality of steps, and said digital signal processor executes said microprogram by a clock signal.

8. A tone signal control system according to claim 7, wherein said microprogram includes an access command to said memory.

9. An electronic musical instrument comprising:

a central processing unit for executing a computational and control operation in accordance with an externally stored program;

a digital signal processor for executing a computational and control operation in accordance with an internally stored program;

a memory accessible by both said central processing unit and said digital signal processor, said central processing unit and said digital signal processor generating an access signal to access said memory;

signal generating means for supplying a tone signal to said digital signal process for; and access control means for controlling an access by said central processing unit and said digital signal processor to said memory, said address control means giving an access priority to said digital signal processor when said access signal by said central processing unit and said access signal by said digital signal processor are generated at the same time.

10. An electronic musical instrument according to claim 9, further comprising delay means for delaying said tone signal.

11. An electronic musical instrument according to claim 9, wherein said delay means includes said memory.

12. An electronic musical instrument according to claim 10, wherein said memory includes a work memory for said central processing unit.

* * * * *